US011855365B1

(12) United States Patent
Chang et al.

(10) Patent No.: US 11,855,365 B1
(45) Date of Patent: Dec. 26, 2023

(54) LOOP ANTENNA

(71) Applicant: KaiKuTek Inc., Taipei (TW)

(72) Inventors: Chih-Feng Chang, Chiayi County (TW); Yi-Cheng Lin, Taipei (TW); Mike Chun-Hung Wang, Taipei (TW)

(73) Assignee: KaiKuTek Inc., Taipei (TW)

( * ) Notice: Subject to any disclaimer, the term of this patent is extended or adjusted under 35 U.S.C. 154(b) by 56 days.

(21) Appl. No.: 17/863,814

(22) Filed: Jul. 13, 2022

(51) Int. Cl.
*H01Q 7/02* (2006.01)
*H01Q 5/385* (2015.01)
*H01Q 9/04* (2006.01)

(52) U.S. Cl.
CPC ..... *H01Q 7/02* (2013.01); *H01Q 5/385* (2015.01); *H01Q 9/0414* (2013.01); *H01Q 9/0442* (2013.01)

(58) Field of Classification Search
CPC ..... H01Q 5/385; H01Q 7/00–08; H01Q 9/26; H01Q 1/2283; H01Q 1/422; H01Q 19/09
USPC ..... 343/702
See application file for complete search history.

(56) References Cited

U.S. PATENT DOCUMENTS 6,114,997 A * 9/2000 Lee ..... H01Q 21/0006 343/846
10,424,847 B2 * 9/2019 Isom ..... H01Q 5/50
10,445,635 B2 * 10/2019 Tenno ..... H01Q 7/00
10,664,738 B2 * 5/2020 Tenno ..... G06K 7/10346
10,965,035 B2 * 3/2021 Rodríguez ..... H01Q 9/30
11,211,688 B2 * 12/2021 Asaf ..... H01Q 1/245
2006/0033664 A1 2/2006 Soler et al.
2020/0259240 A1 * 8/2020 Moallem ..... H01Q 1/2283
2023/0216189 A1 * 7/2023 Woo ..... H01P 5/10 343/846

FOREIGN PATENT DOCUMENTS

CN 113994345 A 1/2022
TW 201830771 A 8/2018
WO WO-2009031700 A1 * 3/2009 ..... H01Q 1/3233
WO 2020102511 A2 5/2020

* cited by examiner

*Primary Examiner* — Ricardo I Magallanes
*Assistant Examiner* — Brandon Sean Woods
(74) *Attorney, Agent, or Firm* — RABIN & BERDO, P.C.

(57) ABSTRACT

A loop antenna which has a signal input/output wire, a first conductor, an upper conductor, an upper conductor, a second conductor, a first lower conductor, and a second lower conductor sequentially connected. The loop antenna further has a first grounding via, and a lower end of the first grounding via is connected to a first grounding layer, and an upper end of the first grounding via is disposed between and connecting the first lower conductor and the second lower conductor, wherein a first end of the second lower conductor is connected to the upper end of the first grounding via, and a second end of the second lower conductor is connected to the first conductor. A second grounding layer and the combination of the signal input/output wire, the first lower conductor, and the second lower conductor are disposed on the same layer disconnectedly.

10 Claims, 9 Drawing Sheets

LOOP ANTENNA

BACKGROUND OF THE INVENTION

1. Field of the Invention

The present invention relates to an antenna structure, especially to a loop antenna.

2. Description of the Related Art

In recent years, there have been many short-range applications of 60 GHz millimeter wave in vehicle detection, indoor detection, and industrial environment detection, such as gesture recognition, people counting, relative displacement detection, safety protection devices, lighting control systems, and building automation, and related standards such as 802.11ad/WiGig, 802.11ay, etc. all use this frequency band. Presently, 60 GHz is a freely available unlicensed band, and the maximum bandwidth can reach 9 GHz, so it can provide more accurate radar readings universally. The wavelength of 60 GHz millimeter wave in air is about 5 millimeters, so the size of the 60 GHz millimeter wave sensor is also relatively small. Since antennas are necessary for various wireless communication applications, the current antenna structures still have to face the problems of how to improve the antenna specifications, such as impedance matching, radiation pattern, impedance bandwidth, and wide beam width.

SUMMARY OF THE INVENTION

In view of the above problems, an objective of the present invention is to provide a loop antenna. The loop antenna disclosed in the present invention can be optimized with respect to impedance matching, radiation pattern, impedance bandwidth, and wide beamwidth.

The loop antenna of the present invention includes:

- a first dielectric layer having a first upper surface and a first lower surface;
- a signal input/output wire, which has a first end and a second end, and is disposed on the first lower surface of the first dielectric layer;
- a first conductor, having an upper end and a lower end, and penetrating through the first dielectric layer, wherein the lower end of the first conductor is connected to the first end of the signal input/output wire;
- an upper conductor, which has a first end and a second end, and is disposed on the first upper surface of the first dielectric layer; wherein the first end of the upper conductor is connected to the upper end of the first conductor;
- a second conductor, having an upper end and a lower end, and penetrating through the first dielectric layer, wherein the upper end of the second conductor is connected to the second end of the upper conductor;
- a second dielectric layer, having a second upper surface and a second lower surface, and disposed under the first dielectric layer;
- a first lower conductor having a first end and a second end, and disposed between the first lower surface of the first dielectric layer and the second upper surface of the second dielectric layer, wherein the first end of the first lower conductor is connected to the lower end of the second conductor;
- a first grounding via having an upper end and a lower end, and through the second dielectric layer, wherein the upper end of the first grounding via is connected to the second end of the first lower conductor;
- a second lower conductor having a first end and a second end, and disposed between the first lower surface of the first dielectric layer and the second upper surface of the second dielectric layer, wherein the first end of the second lower conductor is connected to the upper end of the first grounding via, and the second end of the second lower conductor is connected to the lower end of the first conductor;
- a first grounding layer disposed between the second lower surface of the second dielectric layer and the second upper surface of the second dielectric layer, wherein the lower end of the first grounding via is connected to the first grounding layer.

Preferably, a distance between the center of the upper end of the first grounding via and the center of the lower end of the first conductor is defined as a length parameter, and a bandwidth, a center frequency, and a ratio of the bandwidth to the center frequency of the loop antenna are adjusted through varying the length parameter.

Preferably, the second end of the signal input/output wire is connected to a signal input/output end, and both the first grounding layer and the lower end of the first grounding via are with a ground potential.

Preferably, the loop antenna further includes a floating conductor, disposed in the first dielectric layer, and having a first floating segment, a second floating segment, and a third floating segment; wherein the third floating segment is disposed at the central position of the floating conductor and is respectively connected to the first floating segment and the second floating segment disposed at two ends of the floating conductor to form one conductor, the center of the third floating segment has a hole, and the second conductor is disposed through the hole such that the floating conductor is not connected to the second conductor. And the electric potential of the floating conductor is a floating potential.

Preferably, the upper conductor further includes: a first parasitic conductor, a second parasitic conductor, and a third parasitic conductor, wherein the first parasitic conductor, the second parasitic conductor, and the third parasitic conductor are all rectangular plates and are disposed around an intersection of the upper conductor and the second conductor and protrude outward along an edge of the upper conductor; and the first floating segment is overlapping with and directly under the first parasitic conductor to form a first capacitor; and the second floating segment is overlapping with and directly under the second parasitic conductor to form a second capacitor; and the third parasitic conductor and the floating conductor form a third capacitor.

DETAILED DESCRIPTION OF THE INVENTION

Figure 1:
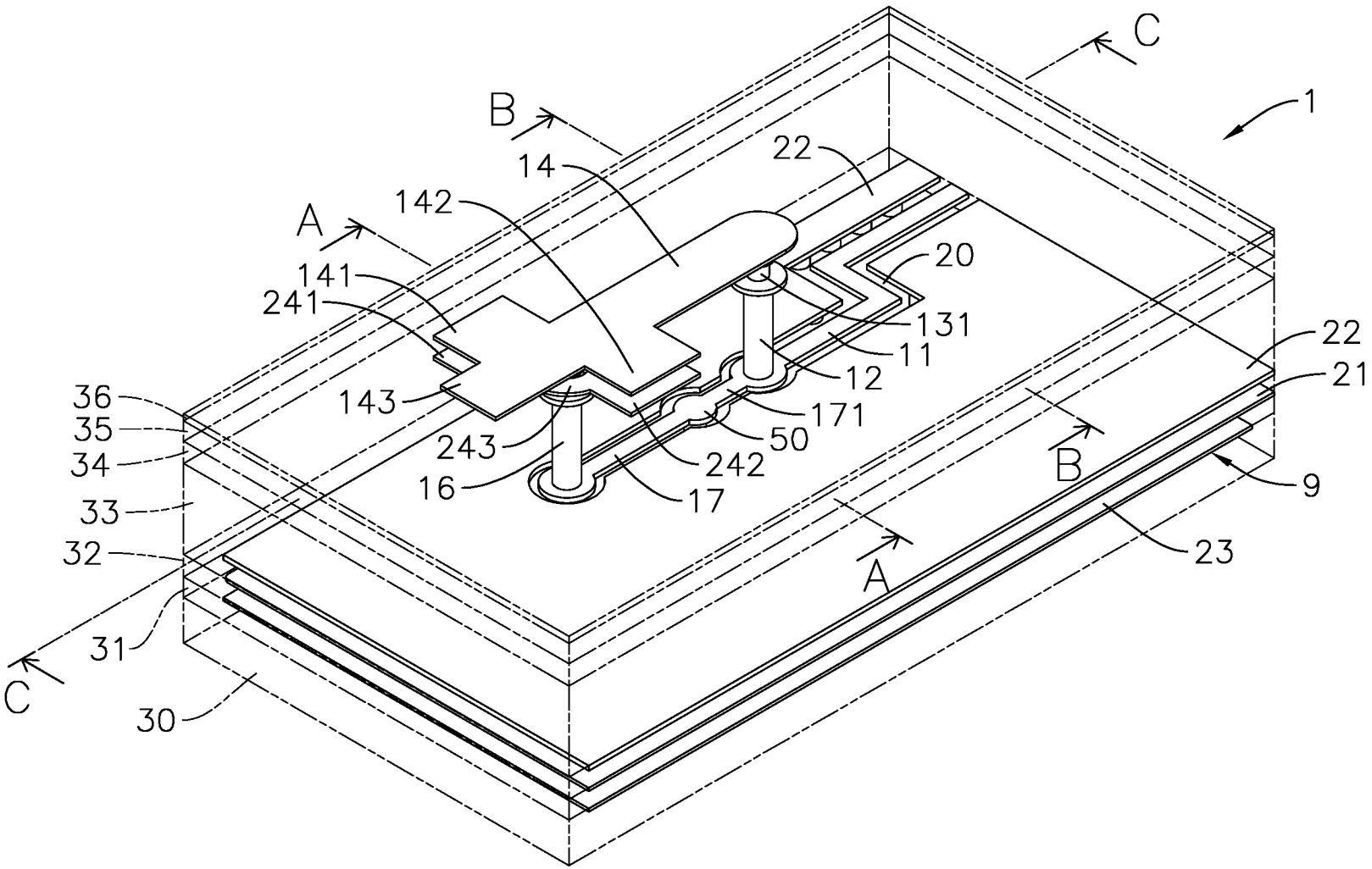
FIG. 1 is a perspective view of the loop antenna of the present invention.

In the following, the technical solutions in the embodiments of the present invention will be clearly and fully described with reference to the drawings in the embodiments of the present invention. Obviously, the described embodiments are only a part of, not all of, the embodiments of the present invention. Based on the embodiments of the present invention, all other embodiments obtained by a person of ordinary skill in the art without creative efforts shall fall within the protection scope of the present invention.

Please refer to FIG. 1 to FIG. 4, which show the geometric structure and shape of the loop antenna 1 of the present invention. The loop antenna 1 includes a signal input/output wire 11, a first plated through hole 12 connected to the signal input/output wire 11, a second plated through hole 131 stacked and connected to the first plated through hole 12, and a third plated through hole 13 stacked and connected to the second plated through hole 131, an upper conductor 14 connected to the third plated through hole 13, a fourth plated through hole 15 connected to the upper conductor 14, a fifth plated through hole 151 stacked and connected to the fourth plated through hole 15, and a sixth plated through hole 16 stacked and connected to the fifth plated through hole 151, a first lower conductor 17 connected to the sixth plated through hole 16, an upper end of a first grounding via 50 connected to the first lower conductor 17, and a second lower conductor 171 of which a first end is connected to the upper end of a first grounding via 50. A second end of the second lower conductor 171 is connected to the first plated through hole 12, wherein the first plated through hole 12, the second plated through hole 131, and the third plated through hole 13 are connected as one conductor called a first conductor; and the fourth plated through hole 15, the fifth plated through hole 151, and the sixth plated through hole 16 are connected as one conductor called a second conductor.

In this way, the loop antenna 1 includes the signal input/output wire 11, the first conductor, the upper conductor 14, the second conductor, the first lower conductor 17, the upper end of the first grounding via 50, and the second lower conductor 171 which are connected end to end to form a loop structure. A lower end of the first grounding via 50 can be connected to a ground voltage (GND), and the signal input/output wire 11 can be connected to a signal input/output end.

In addition, the upper conductor 14 further includes a first parasitic conductor 141, a second parasitic conductor 142, and a third parasitic conductor 143, wherein the first parasitic conductor 141, the second parasitic conductor 142, and the third parasitic conductor 143 are all rectangular plates and are arranged around the intersection of the upper conductor 14 and the fourth plated through hole 15, and protruding outward along the edge of the upper conductor 14. In addition, the loop antenna 1 further includes a floating conductor 24 composed of a first floating segment 241, a second floating segment 242, and a third floating segment 243, wherein the first floating segment 241 and the first parasitic conductor 141 have similar shapes and sizes, and the first floating segment 241 is disposed to be overlapping with and directly under the first parasitic conductor 141 to form a first capacitor. The shapes and sizes of the second floating segment 242 and the second parasitic conductor 142 are also similar, and the second floating segment 242 is arranged to be overlapping with and directly under the second parasitic conductor 142 to form a second capacitor. The third floating segment 243 is disposed at the center of the floating conductor 24 and is respectively connected with the first floating segment 241 and the second floating segment 242 disposed at both ends of the floating conductor 24, as one conductor. There is a round hole at the center of the third floating segment 243. The intersection of the fourth plated through hole 15 and the fifth plated through hole 151 is at the round hole, and the floating conductor 24 is not connected to the fourth plated through hole 15, the fifth plated through hole 151 and other parts of the loop antenna 1, so the potential of the floating conductor 24 can be regarded as floating. The third parasitic conductor 143 and the floating conductor 24 form a third capacitor.

Figure 2:
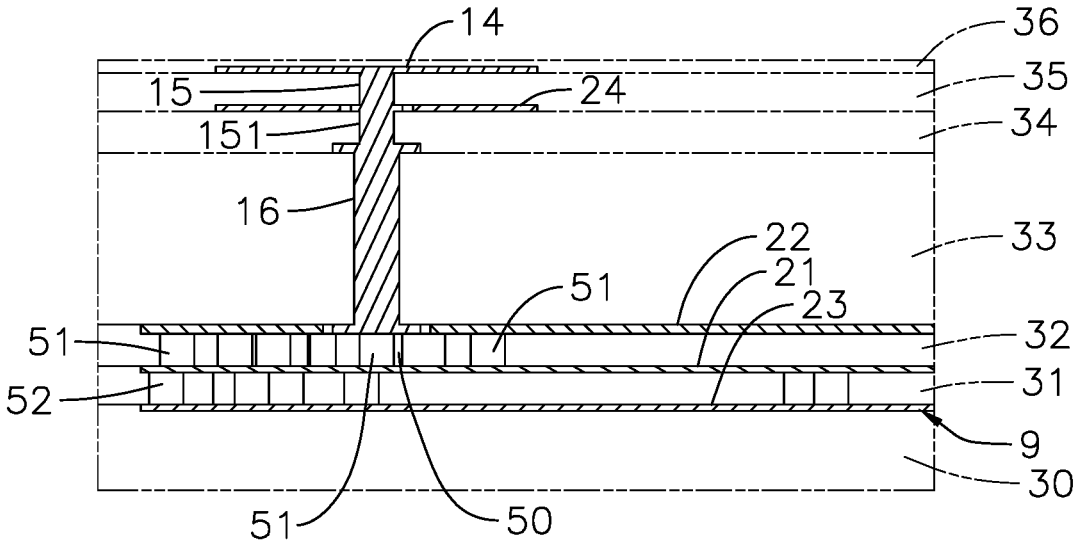
FIG. 2 is an A-A sectional view of the loop antenna as shown in FIG. 1.

Please refer to FIGS. 1 and 2. FIG. 2 shows the A-A sectional view of the loop antenna 1 of the present invention as shown in FIG. 1. The loop antenna 1 of the present invention is disposed on a conductive bottom layer 9. The conductive bottom layer 9 is disposed above a base substrate 30 and under a third dielectric layer 31; a third grounding layer 23 and a signal wire 19 are both disposed in the conductive bottom layer 9 (please refer to FIG. 7), and there is a gap (not shown) between the third grounding layer 23 and the signal wires 19, so that the third grounding layer 23 and the signal wire 19 are not connected with each other. The third dielectric layer 31 is disposed on an upper surface of the conductive bottom layer 9. A first grounding layer 21 is disposed on an upper surface of the third dielectric layer 31, a second dielectric layer 32 is disposed on an upper surface of the first grounding layer 21, and on an upper surface of the second dielectric layer 32, there disposed are a second grounding layer 22 and a portion of components of the loop antenna 1 of the present invention including: the signal input/output wire 11, the first lower conductor 17, the second lower conductor 171, a lower end of the first conductor (i.e. a lower end of the first plated through hole 12), and a lower end of the second conductor (i.e. the lower end of the sixth plated through hole 16). A third substrate layer 33 is disposed on an upper surface of the second grounding layer 22 and over said portion of components of the loop antenna 1 of the present invention, and a fourth substrate layer 34 is disposed on an upper surface of the third substrate layer 33. The floating conductor 24 is disposed on an upper surface of the fourth substrate layer 34, and a fifth substrate layer 35 is disposed on an upper surface of the fourth substrate layer 34 and over the floating conductor 24, and the upper conductor 14 is disposed on an upper surface of the fifth substrate layer 35, and an anti-oxidation layer 36 is disposed on the upper surface of the fifth substrate layer 35 and over the upper conductor 14, wherein the third substrate layer 33, the fourth substrate layer 34, and the fifth substrate layer 35 together form one stacked insulator called a first dielectric layer.

Wherein, the first grounding layer 21, the second grounding layer 22, and the third grounding layer 23 are all made of conductive material (such as metal) and can be connected to the ground voltage (GND), and a plurality of ninth plated through holes 51 are disposed between and conducting the first grounding layer 21 and the second grounding layer 22. The loop antenna 1 of the present invention is connected to the first grounding layer 21 only through the first grounding via 50 (refer to FIG. 4A) to conduct the ground voltage (GND), and the loop antenna 1 of the present invention is not directly connected to the plurality of the ninth plated through holes 51.

In addition to the second grounding layer 22 disposed on the second layer 32, said portion of the components of the loop antenna 1 of the present invention is also disposed on the second layer 32, which includes the signal input/output wire 11, the first lower conductor 17, the second lower conductor 171, a lower end of the first plated through hole 12, a lower end of the sixth plated through hole 16, and an upper end of the first grounding via 50. There is an insulation gap 20 between the second grounding layer 22 and said portion of the components of the loop antenna 1 of the present invention to disconnect the two, so that the second grounding layer 22 and said portion of the components of the loop antenna 1 of the present invention are not directly connected.

Figure 3:
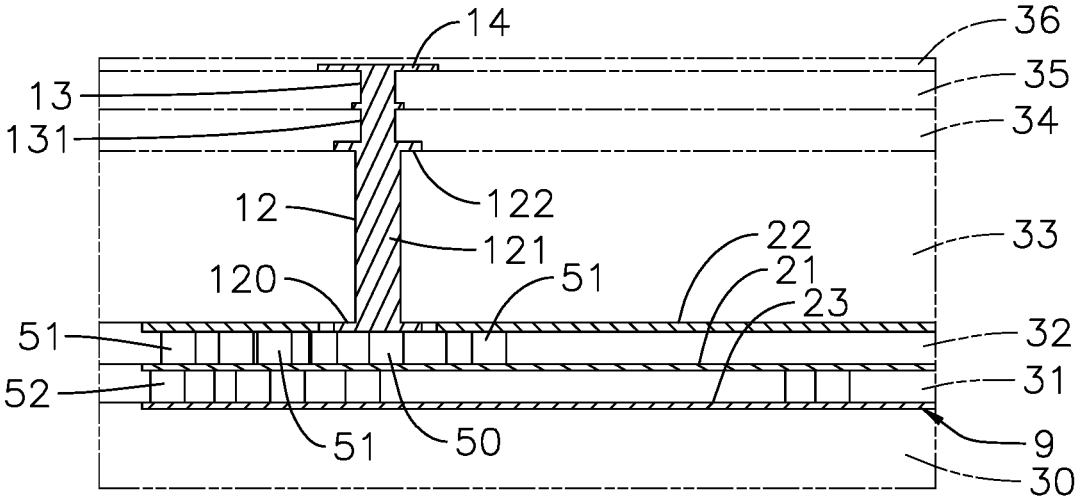
FIG. 3 is a B-B sectional view of the loop antenna as shown in FIG. 1.

Please refer to FIGS. 1-3. FIG. 3 shows a B-B cross-sectional view of the loop antenna 1 of the present invention as shown in FIG. 1. It can be seen that the second lower conductor 171, the lower end of the first plated through hole 12, and the upper end of the first grounding via 50 are connected. In addition, the first plated through hole 12, the second plated through hole 131, and the third plated through hole 13 are stacked and connected to form the first conductor. An upper end of the third plated through hole 13 is connected to the upper conductor 14, and the lower end of the first plated through hole 12 is not directly connected to the plurality of ninth plated through holes 51.

Figure 4A:
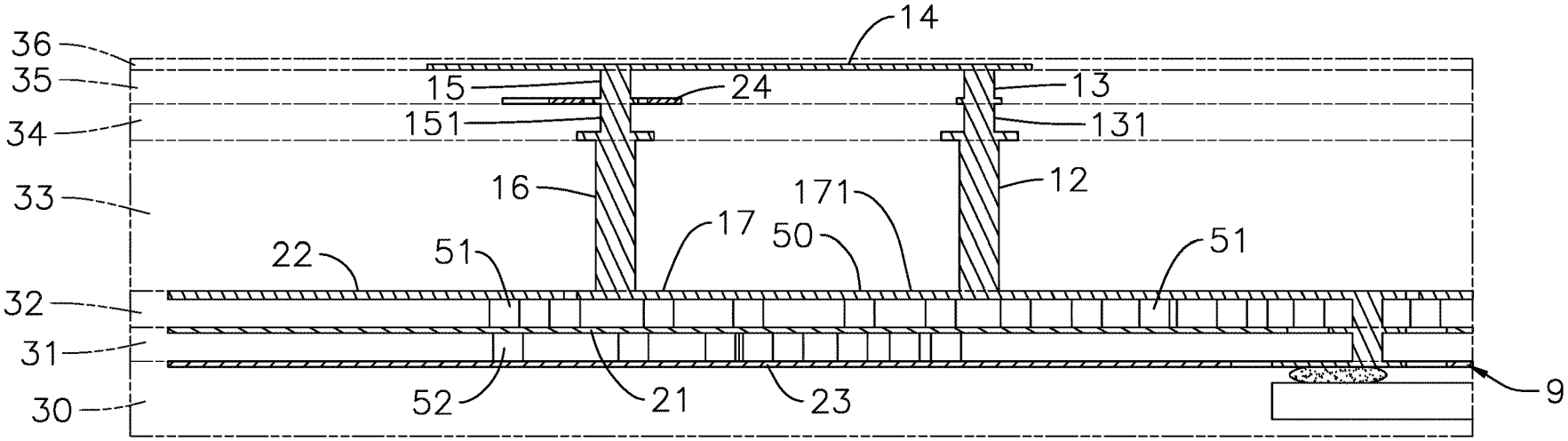
FIG. 4A is a C-C sectional view of the loop antenna as shown in FIG. 1.

Please refer to FIGS. 1-4A and 4B. FIG. 4A shows a C-C cross-sectional view of the loop antenna 1 of the present invention as shown in FIG. 1, wherein an upper end of the first grounding via 50 is disposed between and connecting the first lower conductor 17 and the second lower conductor 171, and a lower end of the first grounding via 50 is directly connected to the first grounding layer 21 to conduct the ground voltage (GND).

Figure 4B:
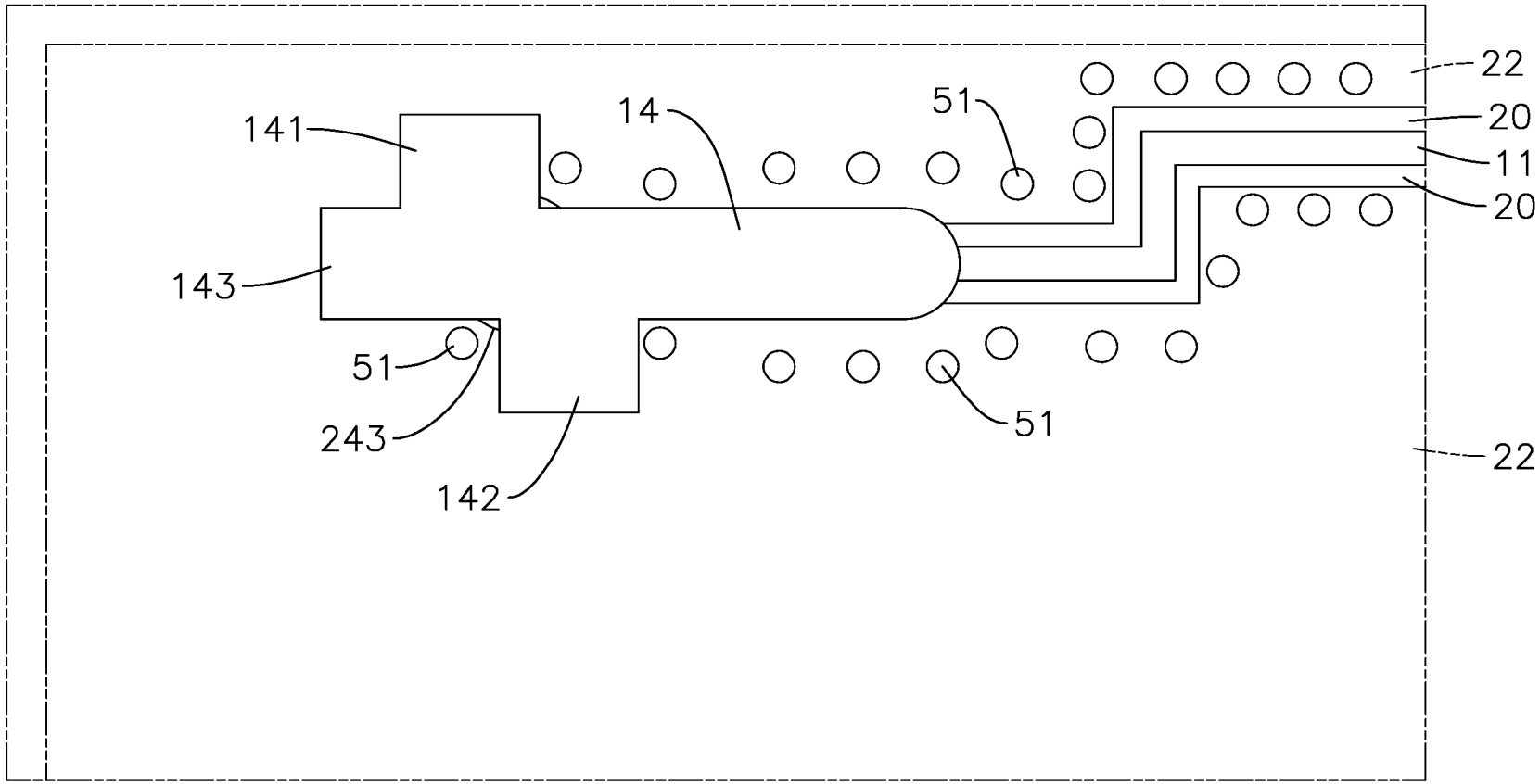
FIG. 4B is a top view of the loop antenna of the present invention.

Please refer to FIGS. 1-4A and 4B, wherein FIG. 4B is a top view of the loop antenna 1 of the present invention. The plurality of ninth plated through holes 51 only surround the loop antenna 1 of the present invention, and are not directly connected to the loop antenna 1 of the present invention.

Figure 5:
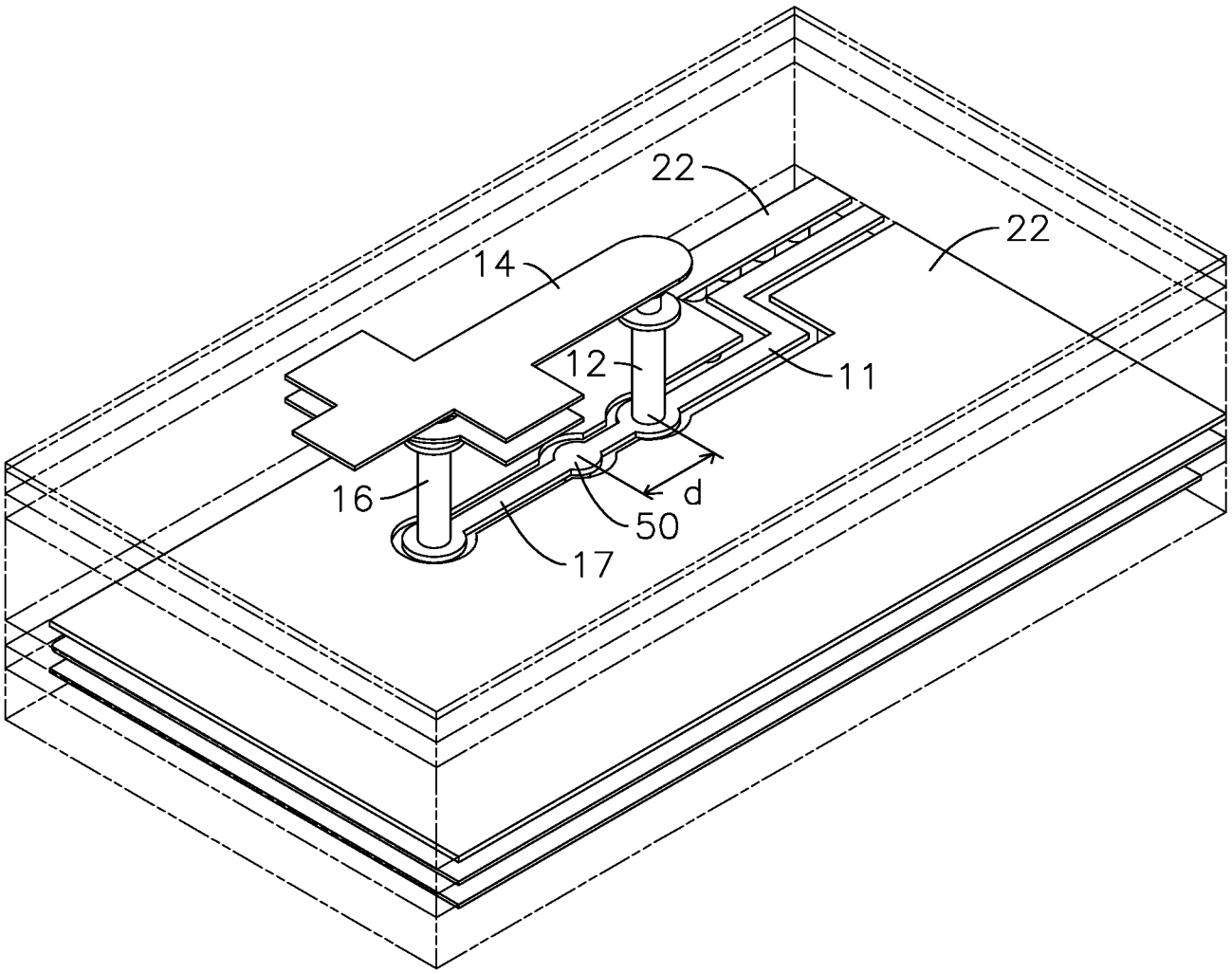
FIG. 5 is a schematic diagram of a length parameter of the loop antenna of the present invention.

Please refer to FIG. 5, which shows a length parameter d of the loop antenna 1 of the present invention. The length parameter d is a distance between the center of the first grounding via 50 and the center of the lower end of the first conductor (i.e. the center of the lower end of the first plated through hole 12). By varying the length parameter d, the reflection coefficient (also called S11 or return loss) of the loop antenna 1 of the present invention can be adjusted accordingly.

Figure 6:
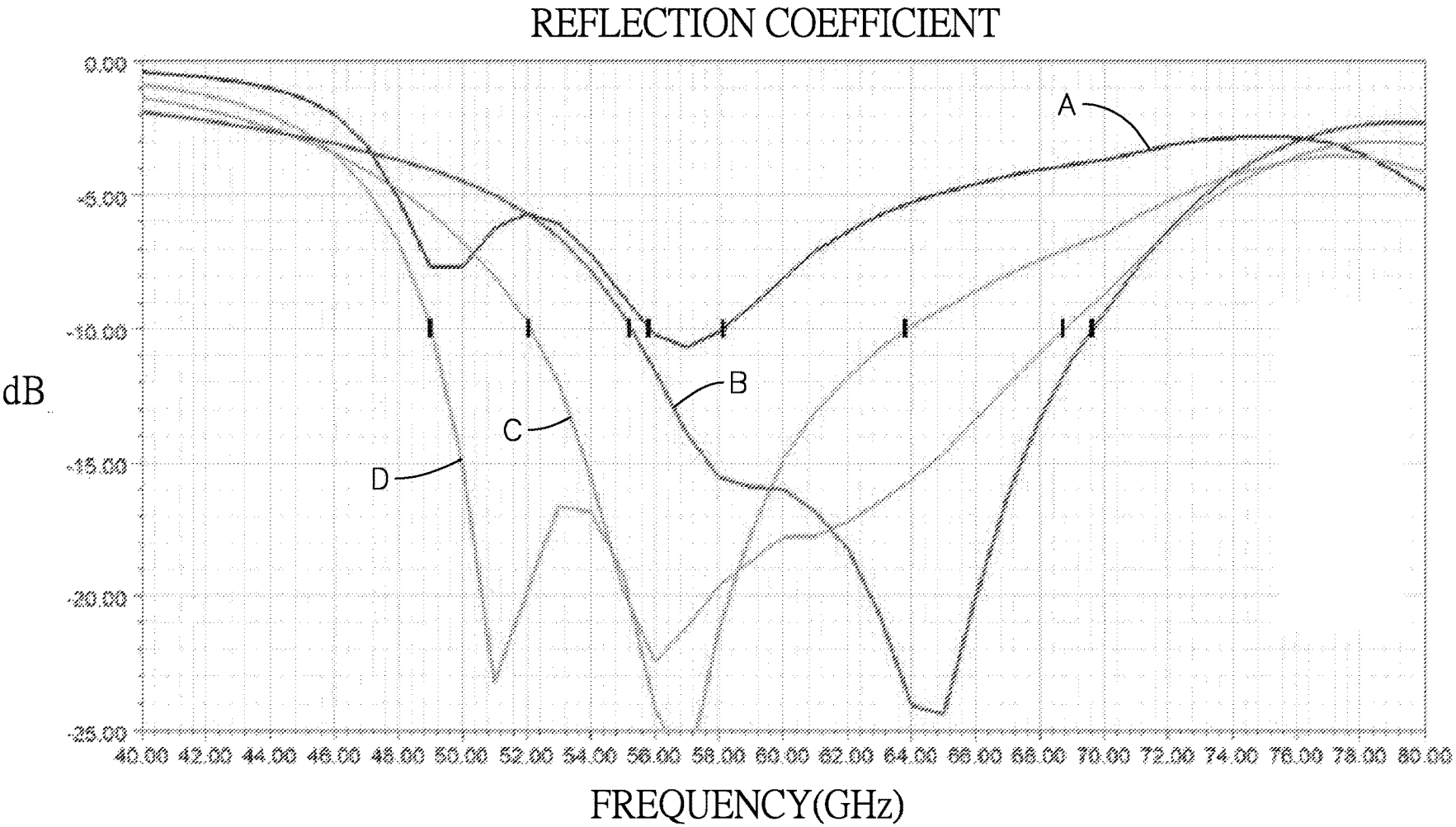
FIG. 6 is a diagram of reflection coefficient spectrums versus corresponding values of a length parameter d of the loop antenna of the present invention.

Please refer to FIG. 6, which shows that when the length parameter d is 0.2 mm, 0.5 mm, 0.4 mm, and 0.3 mm, the loop antenna 1 of the present invention has different reflection coefficient spectra A, B, C, and D, respectively. In FIG. 6, if the reflection coefficient at −10 decibels (dB) is used to define a bandwidth (BW), and the midpoint of the bandwidth is defined as the center frequency (CF), and then a bandwidth to center frequency ratio (BW-ratio) is defined as BW-ratio=BW/CF. When the length parameter d is 0.2 mm, 0.5 mm, 0.4 mm, 0.3 mm, then the corresponding bandwidth-to-center frequency ratios (BW-ratio) are respectively 1%, 23%, 27.5%, 26.3%. It can be seen that by varying the length parameter d of the loop antenna 1 of the present invention, the antenna specifications including the bandwidth (BW), the center frequency (CF) and the ratio of the bandwidth to the center frequency (BW-ratio) of the loop antenna 1 of the present invention, can be effectively adjusted and improved.

As shown in FIG. 6, the intersections of the reflection coefficient spectra A, B, C, D and the −10 decibels (dB) line are marked with vertical line segments, and thereby the size of the bandwidth of the reflection coefficient spectra A, B, C, and D can be deduced with a relationship C>D>B>A. Likewise, the relationship between the center frequencies of the reflection coefficient spectra A, B, C, and D can be deduced with a relationship B>C>A>D. It is worth mentioning that when the value of the length parameter d is 0.4 mm, the bandwidth (BW) of the reflection coefficient spectrum C corresponding to the loop antenna 1 of the present invention is 16.63 GHz, and the center frequency (CF) is 60.44 GHz, and the ratio of the bandwidth to the center frequency (BW-ratio) is 27.5%, so when the value of the length parameter d is 0.4 mm, the loop antenna 1 of the present invention is suitable for the application of 60 GHz millimeter wave.

At the same time, the first to third capacitors respectively formed by the first parasitic conductor 141, the second parasitic conductor 142, and the third parasitic conductor 143 of the loop antenna 1 of the present invention with the corresponding floating conductor 24 can also improve the antenna specifications including radiation pattern and impedance matching of the loop antenna 1 of the present invention.

Figure 7:
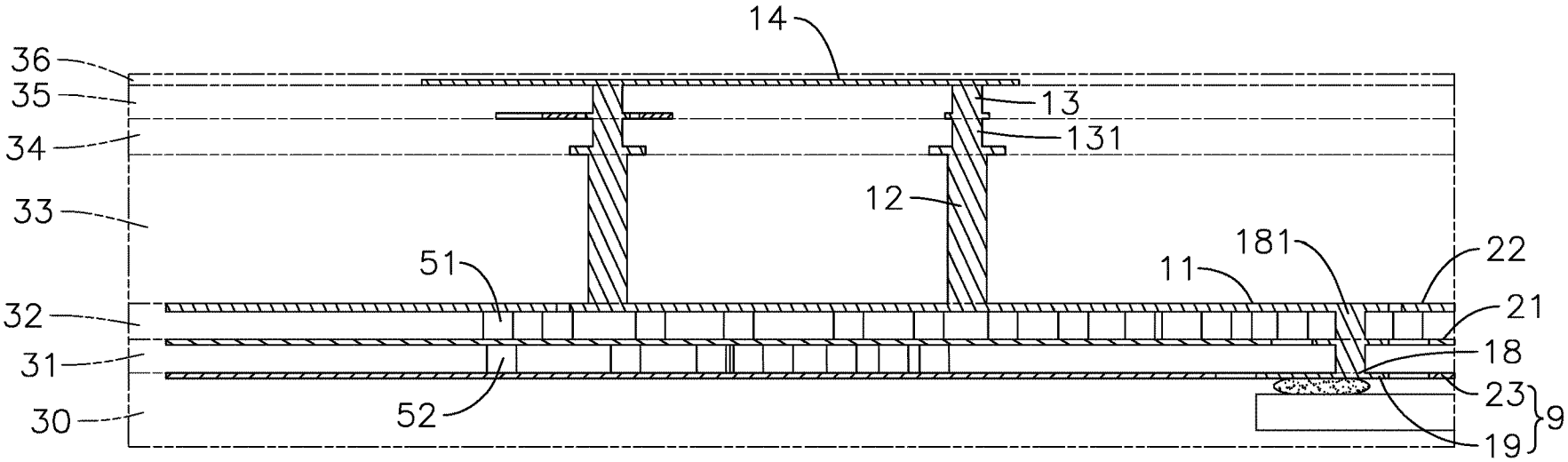
FIGS. 7 and 8 are cross-sectional views of the loop antenna of the present invention connected to the signal input/output end of a system chip.
Figure 8:
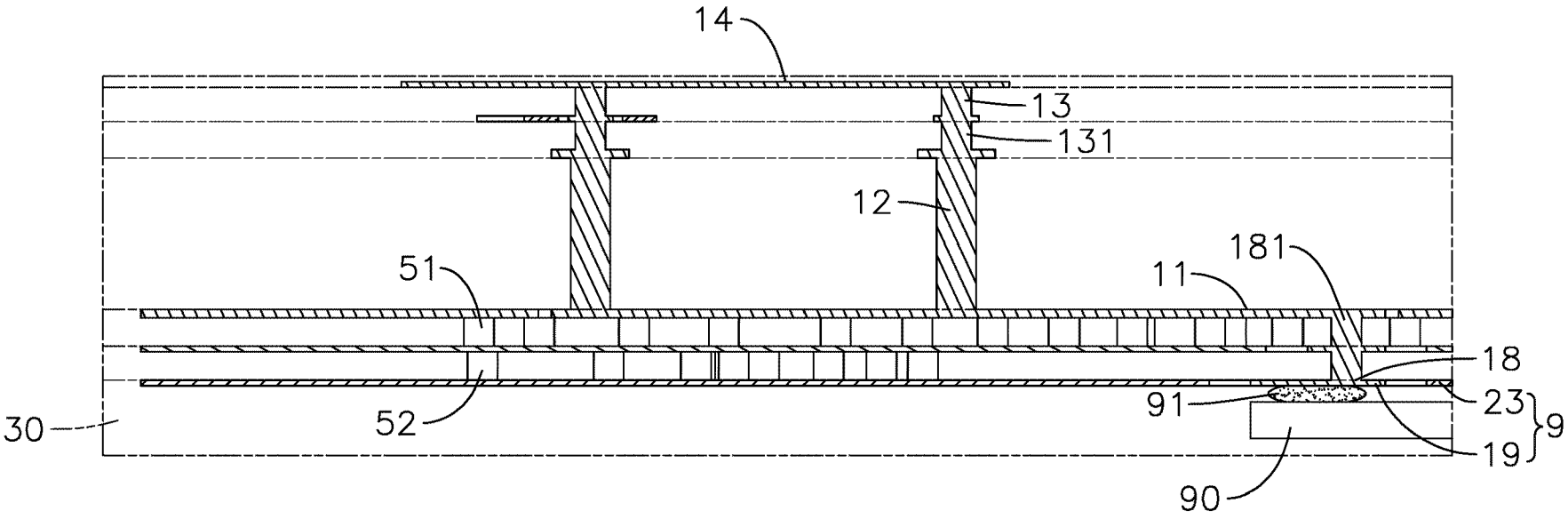

Please refer to FIGS. 7 and 8. FIGS. 7 and 8 are cross-sectional views of the loop antenna 1 of the present invention connected to the signal input/output terminal of a system chip. The signal input/output wire 11 is connected to the signal wire 19 in the conductive bottom layer 9 via a seventh plated through hole 18 and an eighth plated through hole 181 stacked with the seventh plated through hole 18, wherein the seventh plated through hole 18 and the eighth plated through hole 181 are connected as one conductor called a third conductor, and the third conductor is not connected to any one of the first grounding layer 21, the second grounding layer 22, or the third grounding layer 23.

A plurality of tenth plated through holes 52 are also disposed between the third grounding layer 23 and the first grounding layer 21 to conduct the two, wherein the plurality of tenth plated through holes 52 only surround the seventh plated through hole 18, and the plurality of tenth plated through holes 52 are not directly connected to the loop antenna 1 of the present invention.

FIG. 8 shows that the signal wire 19 as shown in FIG. 7 is connected to a pin 91 (i.e. the signal input/output terminal) of a system chip 90, so that the system chip 90 is able to either send output signals to the loop antenna 1 of the present invention for transmission, or receive input signals sensed by the loop antenna 1 of the present invention. The system chip 90 is disposed in an accommodating space (not shown) of the base substrate 30 and below the conductive bottom layer 9, and the system chip 90 can be a system-on-chip (SOC) or a thin and compact printed circuit board assembly (PCBA).

The above-mentioned the first to the tenth plated through holes 12, 131, 13, 15, 151, 16, 18, 181, 51, 52 each have a conductive column and an upper end and a lower end connected with the conductive column, the conductive column is disposed in a through hole of an insulator layer, the upper end and the lower end are respectively arranged around an upper surface and a lower surface of the conductive column, and the upper end and the lower end are also disposed respectively on an upper surface and a lower surface of the insulator layer, wherein the upper end, the lower end and the conductive column are all conductors and together they form one conductor.

For example: in FIG. 3, a conductive column 121 of the first plated through hole 12 is disposed in a through hole of the third substrate layer 33 (not shown, the through hole can be regarded as overlapping with the conductive column 121), and the through hole is through the third substrate layer 33, an upper end 122 and a lower end 120 of the first plated through hole 12 are respectively disposed around an upper surface and a lower surface of the conductive column 121, and the upper end 122 of the first plated through hole 12 is disposed between an upper surface of the third substrate layer 33 and a lower surface of the fourth substrate layer 34, and the lower end 120 of the first plated through hole 12 is disposed between a lower surface of the third substrate layer 33 and an upper surface of the second dielectric layer 32. In addition, the second to the tenth plated through holes 131, 13, 15, 151, 16, 18, 51, and 52 all have structures and arrangements similar to those of the first plated through holes 12.

The aforementioned are preferred embodiments of the present invention. It should be noted that for those of ordinary skill in the art, without departing from the principles of the present invention, certain improvements and retouches of the present invention can still be made which are nevertheless considered as within the protection scope of the present invention.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A loop antenna, including:

a first dielectric layer having a first upper surface and a first lower surface;

a signal input/output wire, which has a first end and a second end, and is disposed on the first lower surface of the first dielectric layer;

a first conductor, having an upper end and a lower end, and penetrating through the first dielectric layer, wherein the lower end of the first conductor is connected to the first end of the signal input/output wire;

an upper conductor, which has a first end and a second end, and is disposed on the first upper surface of the first dielectric layer; wherein the first end of the upper conductor is connected to the upper end of the first conductor;

a second conductor, having an upper end and a lower end, and penetrating through the first dielectric layer, wherein the upper end of the second conductor is connected to the second end of the upper conductor;

a second dielectric layer, having a second upper surface and a second lower surface, and disposed under the first dielectric layer;

a first lower conductor having a first end and a second end, and disposed between the first lower surface of the first dielectric layer and the second upper surface of the second dielectric layer, wherein the first end of the first lower conductor is connected to the lower end of the second conductor;

a first grounding via having an upper end and a lower end, and through the second dielectric layer, wherein the upper end of the first grounding via is connected to the second end of the first lower conductor;

a second lower conductor having a first end and a second end, and disposed between the first lower surface of the first dielectric layer and the second upper surface of the second dielectric layer, wherein the first end of the second lower conductor is connected to the upper end of the first grounding via, and the second end of the second lower conductor is connected to the lower end of the first conductor;

a first grounding layer disposed between the second lower surface of the second dielectric layer and the second upper surface of the second dielectric layer, wherein the lower end of the first grounding via is connected to the first grounding layer.

2. The loop antenna as claimed in claim 1, wherein a distance between the center of the upper end of the first grounding via and the center of the lower end of the first conductor is defined as a length parameter, and a bandwidth, a center frequency, and a ratio of the bandwidth to the center frequency of the loop antenna are adjusted through varying the length parameter.

3. The loop antenna as claimed in claim 1, wherein the second end of the signal input/output wire is connected to a signal input/output end; and both the first grounding layer and the lower end of the first grounding via are with a ground potential.

4. The loop antenna as claimed in claim 1, further including:

a floating conductor, disposed in the first dielectric layer, and having a first floating segment, a second floating segment, and a third floating segment; wherein the third floating segment is disposed at the central position of the floating conductor and is respectively connected to the first floating segment and the second floating segment disposed at two ends of the floating conductor to form one conductor, the center of the third floating segment has a hole, and the second conductor is disposed through the hole such that the floating conductor is not connected to the second conductor.

5. The loop antenna as claimed in claim 4, wherein the electric potential of the floating conductor is a floating potential.

6. The loop antenna as claimed in claim 1, wherein the upper conductor includes:

a first parasitic conductor, a second parasitic conductor, and a third parasitic conductor, wherein the first parasitic conductor, the second parasitic conductor, and the third parasitic conductor are all rectangular plates and are disposed around an intersection of the upper conductor and the second conductor and protrude outward along an edge of the upper conductor.

7. The loop antenna as claimed in claim 4, wherein the upper conductor includes:

a first parasitic conductor, a second parasitic conductor, and a third parasitic conductor, wherein the first parasitic conductor, the second parasitic conductor, and the third parasitic conductor are all rectangular plates and are disposed around an intersection of the upper conductor and the second conductor and protrude outward along an edge of the upper conductor;

the first floating segment is overlapping with and directly under the first parasitic conductor to form a first capacitor; the second floating segment is overlapping with and directly under the second parasitic conductor to form a second capacitor; and the third parasitic conductor and the floating conductor form a third capacitor.

8. The loop antenna as claimed in claim 1, further including:

a second grounding layer disposed between the first lower surface of the first dielectric layer and the second upper surface of the second dielectric layer; wherein a gap is between the second grounding layer and a combination of the signal input/output wire, the first lower conductor, and the second lower conductor;

a third dielectric layer, having a third upper surface and a third lower surface, and disposed under the second dielectric layer;

a third grounding layer, disposed on the third lower surface of the third dielectric layer;

a signal wire, having a first end and a second end, and disposed on the third lower surface of the third dielectric layer, wherein a gap is between the signal wire and the third grounding layer;

a third conductor, having an upper end and a lower end, and penetrating the second dielectric layer and the third dielectric layer, wherein the second end of the signal input/output wire is connected to the upper end of the third conductor, and the lower end of the third conductor is connected to the first end of the signal wire.

9. The loop antenna as claimed in claim 3, wherein the signal input/output end is a signal input/output terminal of a system chip.

10. The loop antenna as claimed in claim 8, wherein the second end of the signal wire is connected to a signal input/output terminal of a system chip.

* * * * *